US006467213B1

(12) United States Patent
Schlenkert et al.

(10) Patent No.: US 6,467,213 B1
(45) Date of Patent: Oct. 22, 2002

(54) METHOD OF PROVIDING A WEAPON BARREL WITH AN INTERNAL HARD CHROMIUM LAYER

(75) Inventors: Gert Schlenkert, Düsseldorf; Horst Reckeweg, Heiligenhaus; Hartmut Wagner, Unterlüss, all of (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 09/442,809

(22) Filed: Nov. 18, 1999

(30) Foreign Application Priority Data

Nov. 19, 1998 (DE) ..... 198 53 293

(51) Int. Cl.[7] ..... F41A 21/04
(52) U.S. Cl. ..... 42/76.02; 42/78; 89/16
(58) Field of Search ..... 29/1.1, 1.11; 89/14.05, 89/16; 42/76.02, 78

(56) References Cited

U.S. PATENT DOCUMENTS

| | | | | | |
|---|---|---|---|---|---|
| 1,886,218 A | | 11/1932 | Olin et al. | | |
| 2,687,591 A | * | 8/1954 | Lamb et al. | ..... | 42/76.02 |
| 2,799,959 A | * | 7/1957 | Osborn | ..... | 42/76.02 |
| 4,622,080 A | | 11/1986 | Wegworth | ..... | 148/12.4 |
| 5,054,224 A | * | 10/1991 | Friar et al. | ..... | 42/76.02 |
| 5,664,359 A | * | 9/1997 | Sabranski et al. | ..... | 42/78 |

FOREIGN PATENT DOCUMENTS

| | | |
|---|---|---|
| DE | 41 07 273 | 9/1992 |
| DE | 195 44824 | 2/1997 |
| DE | 197 41028 | 11/1998 |
| FR | 2 460 340 | 1/1981 |
| GB | 810494 | 3/1959 |

* cited by examiner

*Primary Examiner*—Stephen M. Johnson
(74) *Attorney, Agent, or Firm*—Venable; Norman N. Kunitz

(57) ABSTRACT

A method of providing an inner surface of a weapon barrel with a hard chromium layer includes the steps of forming the hard chromium layer on the inner surface by galvanic separation; and thereafter heating the hard chromium layer beyond the re-crystallization temperature thereof for obtaining, upon conclusion of the heating step, a uniform re-crystallization of the hard chromium layer in its entirety.

5 Claims, 1 Drawing Sheet

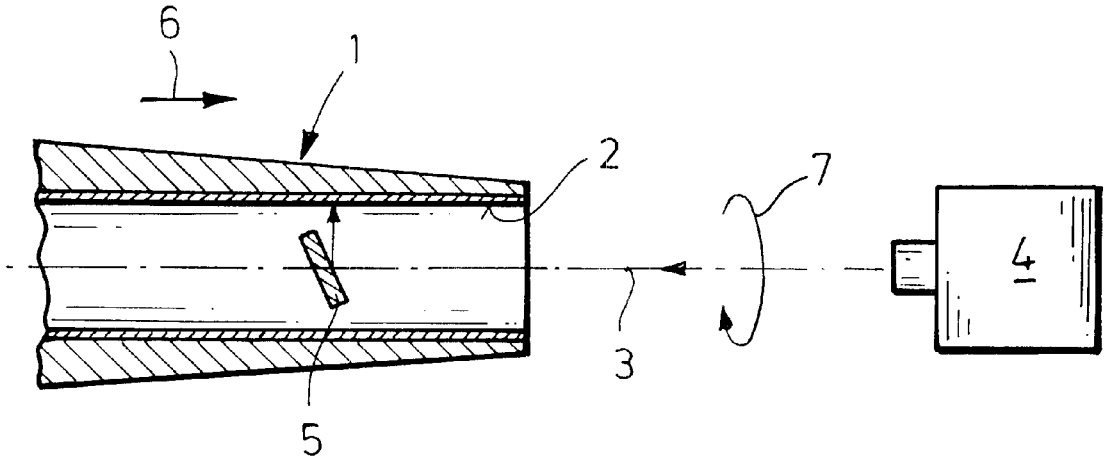
6
1
2
7
4
3
5

METHOD OF PROVIDING A WEAPON BARREL WITH AN INTERNAL HARD CHROMIUM LAYER

CROSS REFERENCE TO RELATED APPLICATION

This application claims the priority of German Application No. 198 53 293.8 filed Nov. 19, 1998, which is incorporated herein by reference.

BACKGROUND OF THE INVENTION

This invention relates to a method of providing a weapon barrel with an internal hard chromium layer.

Upon firing of ammunition from a weapon barrel, the hot burning gases lead to abrasive and erosive wear phenomena in case the inner wall surface of the usually steel weapon barrel is not protected. Such wear adversely affects the performance and accuracy of the weapon and leads to a premature material fatigue of the barrel.

According to German Offenlegungsschrift (application published without examination) 41 07 273, a hard chromium layer is provided on the inner wall face of the weapon barrel by means of a galvanic separation of chromium for reducing an erosive wear. Such a chromium layer substantially suppresses erosion phenomena due to the higher melting point relative to the barrel steel and a better chemical inertia.

It has been found, however, that the high thermal shock derived from firing the weapon may cause peeling of the chromium layer so that the weapon barrel, at the locations which are no longer protected by the chromium layer, is exposed to the high-temperature gases, thus resulting in erosion. Further, the hard chromium layer has the disadvantage that, because of its high degree of hardness and the poor ductility coupled therewith, it does not resist mechanical damages in a satisfactory manner.

SUMMARY OF THE INVENTION

It is an object of the invention to provide an improved method for making a weapon barrel, whose inner chromium layer has an improved thermal shock resistance compared to conventional hard chromium layers.

This object and others to become apparent as the specification progresses, are accomplished by the invention, according to which, briefly stated, the method of providing an inner surface of a weapon barrel with a hard chromium layer includes the steps of forming the hard chromium layer on the inner surface by galvanic separation; and thereafter heating the hard chromium layer beyond the re-crystallization temperature thereof for obtaining, upon conclusion of the heating step, a uniform re-crystallization of the hard chromium layer in its entirety.

Essentially, the invention is based on the principle to submit the galvanically separated hard chromium layer to a thermal post treatment before placing the weapon into service. The temperature of the post treatment is selected such that the chromium crystals which have been formed during the galvanic separation are re-crystallized so that a ferritic re-crystallized structure is obtained. This leads to a significant reduction of the hardness and thus to an improvement of the ductility of the chromium layer.

For the re-crystallization of the hard chromium layer temperatures of above 500° C. are needed. The duration of the heat treatment of the chromium layer must be selected such that a negative effect on the basic material of the weapon barrel is prevented. Thus, for example, in case of steel weapon barrels that have undergone autofrettage, the temperature of the basic material must not lie above 300° C.

The heat-up of the hard chromium layer to a temperature above 500° C., while taking into consideration the fact that the basic material of the weapon barrel must not be heated above 300° C., is advantageously achieved by a brief irradiation of the hard chromium layer with a high-power laser beam or a high-energy lamp in combination with a suitable optical system and/or masking. The chromium layer may be heated once or several times for obtaining a complete re-crystallization. A multiple heating offers better conditions than a single heat-up to ensure that the basic material of a weapon barrel that underwent autofrettage is not heated above 300° C.

In weapon barrels that have not undergone autofrettage the heat treatment of the chromium may be carried out by heating the weapon barrel in an oven as long as the required re-crystallization temperature of the hard chromium is under the annealing temperature of the barrel material.

It has been found in practice that as a result of the high stresses when firing a shot, a re-crystallization of the hard chromium layer may take place in conventional weapon barrels in any event. During such an occurrence, however, only certain regions of the chromium layer are re-crystallized in a non-defined manner, so that the chromium layer has regions of different material properties. In contrast to the controlled re-crystallization of the entire hard chromium layer according to the invention before using the weapon, such spontaneous re-crystallized regions lead to a further damaging of the hard chromium layer.

In addition to an improvement of the thermal shock resistance of the hard chromium layer, the method according to the invention has, among others, the following additional advantages:

- No structural gradients appear during the use of the weapon barrel.
- The expansion of the chromium layer is improved compared to the conventional weapon barrels due to the re-crystallization structure.
- Thicker stable chromium layers may be applied to the inner face of the weapon barrel which make possible an improved thermal protection of the basic material of the weapon barrel as compared to conventional weapon barrels.
- As concerns mechanical stresses caused by firing the weapon, the chromium layer according to the invention is, compared to weapon barrels of conventional type, less sensitive and therefore the invention may be used particularly advantageously in automatic weapons as well.
- The service life of the weapon barrel made according to the invention is greater than weapon barrels provided with a conventional chromium layer.

BRIEF DESCRIPTION OF THE DRAWING

The sole FIGURE is an axial sectional view of the muzzle region of a weapon barrel, also showing schematically an apparatus for performing the method according to the invention.

DESCRIPTION OF THE PREFERRED EMBODIMENT

Turning to the FIGURE, a hard chromium layer 2 is deposited on the inner face of a weapon barrel 1 by means of galvanic separation. To achieve subsequently a uniform re-crystallization of the hard chromium layer 2, a laser beam 3 is utilized which is emitted, for example, by a 5 KW $CO_2$ laser 4 and is axially directed into the muzzle of the weapon barrel 1. By means of a mirror 5 positioned within the weapon barrel the laser beam 3 is deflected such that it impinges on the hard chromium layer 2 and causes a heat-up thereof.

As shown by the arrows 6 and 7, between the weapon barrel 1 and the mirror 5 a relative axial and radial motion is effected in such a manner that the location of impingement of the laser beam 3 follows the rifling of the weapon barrel 1. By means of the laser parameters, such as performance, area of beam impingement and process speed, the depth and duration of treatment and thus the heating of the hard chromium layer 2 are controlled.

It will be understood that the above description of the present invention is susceptible to various modifications, changes and adaptations, and the same are intended to be comprehended within the meaning and range of equivalents of the appended claims.

What is claimed is:

1. A method of providing an inner surface of a weapon barrel with a chromium layer; said weapon barrel having a base material; the method comprising the following steps:

(a) forming the chromium layer on said inner surface by galvanic separation;

(b) after step (a), heating the chromium layer to a temperature for obtaining, upon conclusion of step (b), a uniform re-crystallization of said chromium layer in its entirety; and (c) controlling a duration of said heating step such that said base material is heated to 300° C. at the most.

2. A method of providing an inner surface of a weapon barrel with a chromium layer, comprising the following steps:

(a) forming the chromium layer on said inner surface by galvanic separation; and (b) after step (a), heating the chromium layer with a laser beam to a temperature for obtaining, upon conclusion of step (b), a uniform re-crystallization of said chromium layer in its entirety.

3. The method as defined in claim 2, wherein said heating step comprises the steps of (a) positioning a mirror in said weapon barrel;

(b) directing the laser beam axially into said weapon barrel for causing said laser beam to be reflected from said mirror onto said hard chromium layer; and (c) effecting a simultaneous relative rotation and axial displacement between said mirror and said weapon barrel.

4. The method as defined in claim 3, wherein said weapon barrel has a rifling and further wherein step (c) is controlled such that a path of impingement of the laser beam on said chromium layer is parallel to said rifling.

5. A method of providing an inner surface of a weapon barrel with a chromium layer, comprising the following steps:

(a) forming the chromium layer on said inner surface by galvanic separation; and (b) after step (a), heating the chromium layer to a temperature for obtaining, upon conclusion of step (b), a uniform re-crystallization of said chromium layer in its entirety; said heating step comprising the step of heating the chromium layer in an oven to a re-crystallization temperature; said re-crystallization temperature being below an annealing temperature of the barrel material.

* * * * *